US005271731A

United States Patent [19]

Hsin-Chung

[11] Patent Number: 5,271,731

[45] Date of Patent: Dec. 21, 1993

[54] AUTOMATICALLY LOCKABLE SAFETY LIGHTER

[76] Inventor: Pan Hsin-Chung, c/o Hung Hsing Patent Service Center, P.O. Box 55-1670, Taipei (10477), Taiwan

[21] Appl. No.: 991,413

[22] Filed: Dec. 16, 1992

[51] Int. Cl.[5] ..... F23D 11/36

[52] U.S. Cl. ..... 431/254; 431/153; 431/277

[58] Field of Search ..... 431/153, 277, 276, 254; 222/153, 402.11

[56] References Cited

U.S. PATENT DOCUMENTS

| | | | |
|---|---|---|---|
| 4,784,602 | 11/1988 | Nitta | 431/153 |
| 5,074,781 | 12/1991 | Fujita | 431/153 |
| 5,165,886 | 11/1992 | Frigiere | 431/153 X |
| 5,197,870 | 3/1993 | Yang | 431/153 |

*Primary Examiner*—Larry Jones

[57] ABSTRACT

A safety lighter includes an actuating lever normally pivotally mounted on a top frame protruding upwardly from a gas container of the lighter for operatively igniting a flint for sparking and burning gas emitted from a gas valve, and a locking stem protruding downwardly from a depression member of the lever depressibly locked on a retarding platform formed on a cover of the gas container for preventing a depression of the lever for igniting an lighter by a child. The actuating lever can be pushed frontwardly to disengage the locking stem of the lever from the retarding platform to allow an ignition of the lighter wherein the locking stem is depressibly enterable into a cavity formed in the container cover, and after igniting depression of the lever, a restoring spring will restore to retract the lever rearwardly for automatically locking the lever from its depression for a safety purpose.

3 Claims, 2 Drawing Sheets

AUTOMATICALLY LOCKABLE SAFETY LIGHTER

BACKGROUND OF THE INVENTION

A conventional child resistant cigarette lighter such as disclosed in U.S. Pat. No. 4,832,596 to Glenn Morris includes a permanently attached stop member slidably mounted on a conventional disposable butane lighter for releasably engaging the gas valve actuating lever. The construction and arrangement of the lighter is such that an adult can easily manipulate the stop member and gas valve actuating lever while igniting, while such manipulation is beyond the dexterity of a child, thereby rendering the lighter child resistant.

However such a conventional gas lighter still has the following drawbacks:

1. The stop member 9 is slidably mounted on the lighter outside a butane container of the lighter, which may obstruct a normal igniting operation when using such a lighter and may even cause inconvenience when storing or handling such a lighter because its increased volume requiring an additional space for allocating such specially-constructed lighter such as in a purse or a pocket.

2. The stop member 9 includes an elongate rod 10 which may be easily broken or deformed by any external object or force to influence its normal operation.

SUMMARY OF THE INVENTION

The object of the present invention is to provide a safety lighter including an actuating lever normally pivotally mounted on a top frame protruding upwardly from a gas container of the lighter for operatively igniting a flint for sparking and burning gas emitted from a gas valve, and a locking stem protruding downwardly from a depression member of the lever depressibly locked on a retarding platform formed on a cover of the gas container for preventing a depression of the lever for igniting the lighter by a child. The actuating lever can be pushed frontwardly to disengage the locking stem of the lever from the retarding platform to allow an ignition of the lighter wherein the locking stem is depressibly enterable into a cavity formed in the container cover, and after igniting depression of the lever, a restoring spring will restore to retract the lever rearwardly for automatically locking the lever from its depression for a safety purpose.

DETAILED DESCRIPTION

Figure 2:
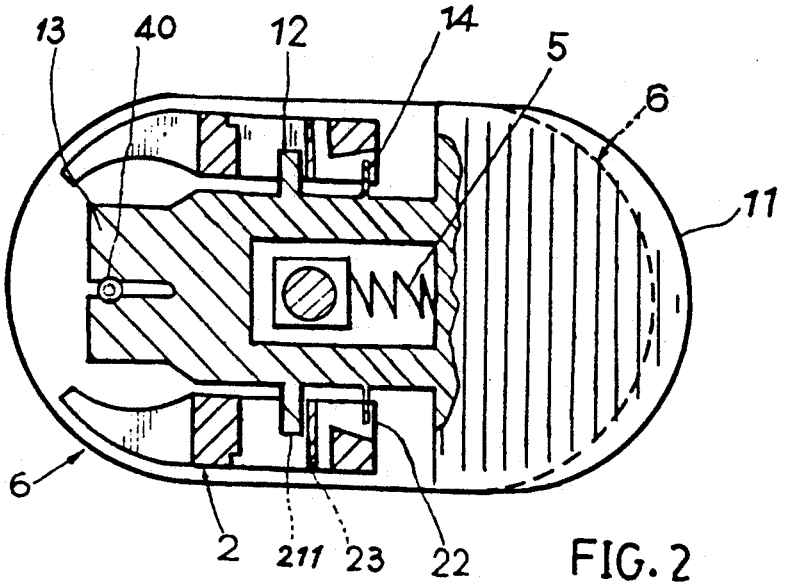
FIG. 2 is a top-view illustration of the present invention as shown in FIG. 1.

As shown in FIGS. 1–4, the present invention comprises: an actuating lever 1 pivotally mounted on a top frame 2 formed on a container cover 62 of a gas container 6 filled with liquid petroleum gas such as butane 61 in the container 6 having an igniting means 3 and a gas valve 4 provided on the gas lighter, and a restoring spring 5 retained between the top frame 2 and the lever 1.

The actuating lever 1 generally inclined upwardly towards the first side A of the container 6 as urged by the spring 5 includes: a depression member 11 formed on a "force" end of the lever 1 at a first side A of the gas container 6, a lever pivot 12 serving as a "fulcrum" of the lever 1 and transversely formed on a middle portion of the lever 1 to be pivotally mounted on the top frame 2, a clip portion 13 formed on a "load" end of the lever for slidably holding a nozzle 40 of the gas valve 4 on the clip portion 13, at least a positioning pin 14 protruding transversely from the lever 1 adjacent to the depression member 11 for temporarily setting the lever 1 at its igniting position when pushing the lever 1 frontwardly towards second side B of the gas container 6 having the gas valve 6 provided in the container 6 at the second side B, a locking stem 15 protruding downwardly from the depression member 11 for normally locking the lever 1 on a container cover 62, and a spring retainer 16 formed on the locking stem 15 for retaining a first spring end 51 of the restoring spring 5 thereon.

Figure 3:
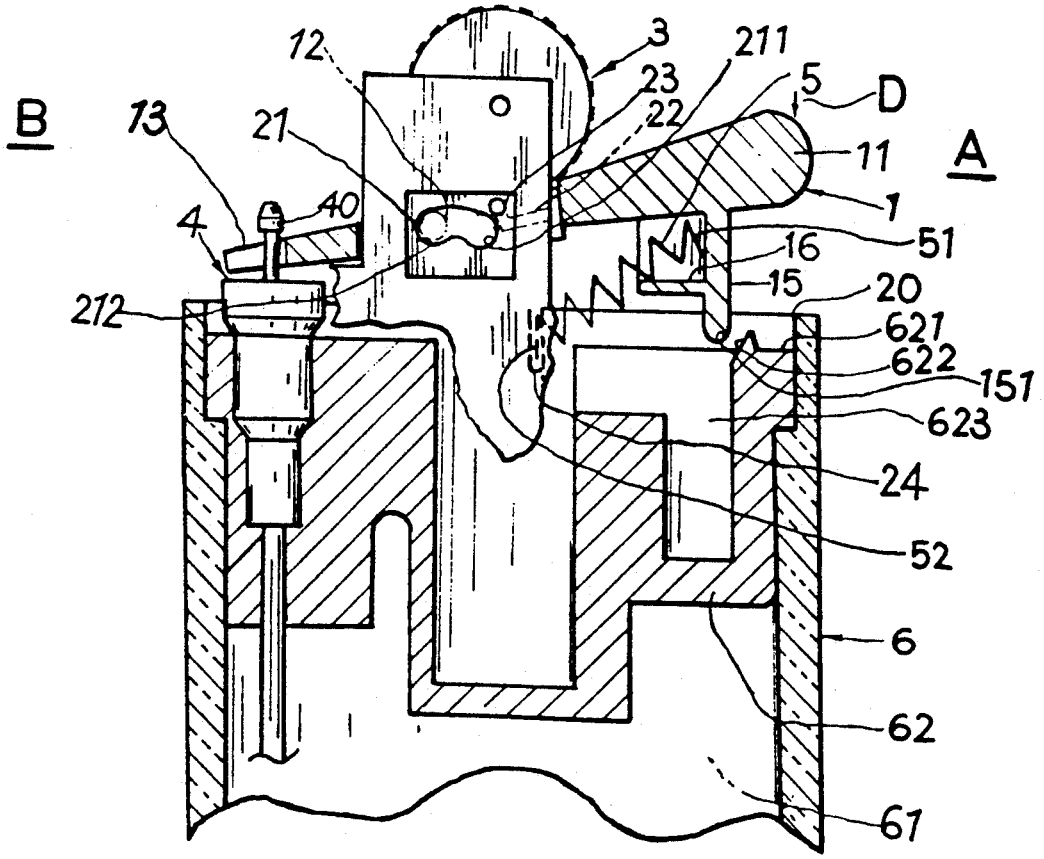
FIG. 3 is a partial sectional drawing of the present invention when unlocked for igniting purpose.

The top frame 2 is protruded upwardly from a container cover 62 sealably secured to an upper portion of the gas container 6 having a flat edge portion 20 formed in between the container cover 62 and a base portion of the top frame 2, an arcuate slot 21 formed in a middle portion of the frame 2 pivotally engageable with the pivot 12 of the lever 1 having a first pivot hole 211 proximate to the depression member 11 and a second pivot hole 212 proximate to the nozzle 40 of the valve 4 formed in two opposite end portions of the arcuate slot 21 for slidably pivoting the pivot 12 of the lever 1, at least a guiding slot 22 inclinedly formed in the top frame 2 adjacent to the arcuate slot 21 for slidably guiding the positioning pin 14 of the lever 1 towards the second side B of the container 6 when pushing the lever 1 frontwardly towards the second side B for igniting the lighter as shown in FIG. 3, at least a positioning socket 23 communicating with the guiding slot 22 and positioned above a deadpoint 221 of the guiding slot 22, at which the positioning pin 14 of the lever 1 is pushed extremely towards an end point of the guiding slot 22 adjacent to the first pivot hole 211 of the arcuate slot 21 for temporarily engaging the positioning pin 14 with the positioning socket 23 when raising the positioning pin 14 as upwardly urged by the restoring spring 5 ready for an igniting depression of the lever for igniting the lighter, and a spring holding portion 24 formed on a base portion of the top frame 2 adjacent to the flat edge portion 20 of the top frame 2 for retaining a second spring end 52 of the restoring spring 5 opposite to the first end 51 for normally urging the restoring spring 5 upwardly towards the first side A of the container.

The container cover 62 includes a retarding platform 621 formed on an upper surface of the container cover 62 proximate to the first side A of the container 6 for stopping a downward depression of the locking stem 15 of the lever 1, a limiting protrusion 622 tapered upwardly from the retarding platform 621, and a stem-enterable cavity 623 recessed downwardly in the cover 62 adjacent to the limiting protrusion 622, with the limiting protrusion 622 positioned between the retarding platform 621 and the stem-enterable cavity 623 to normally limit the locking stem 15 from dropping into the cavity 623 when locking the actuating lever 1 and with the cavity 623 provided for a downward depression of the locking stem 15 when operatively depressing the lever 1 for igniting the lighter.

Figure 1:
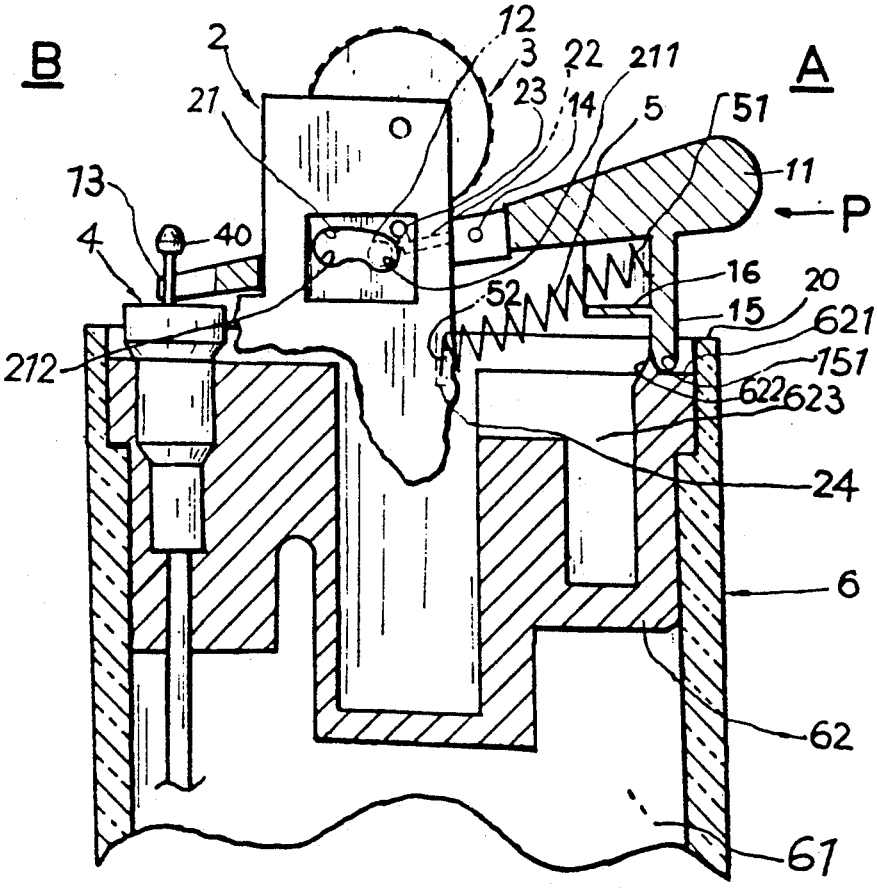
FIG. 1 is a partial sectional drawing of the present invention under locking condition.

The restoring spring 5 normally urges the actuating lever 1 upwardly rearwardly towards the first side A of the container 6 to trip a lower stem portion 151 of the locking stem 15 over the limiting protrusion 622 on the container cover 62 to prevent a downward depression of the stem 15 and of the lever 1 for enhancing a lighter safety especially preventing an unexpected ignition by an innocent child as shown in FIGS. 1, 2.

Figure 4:
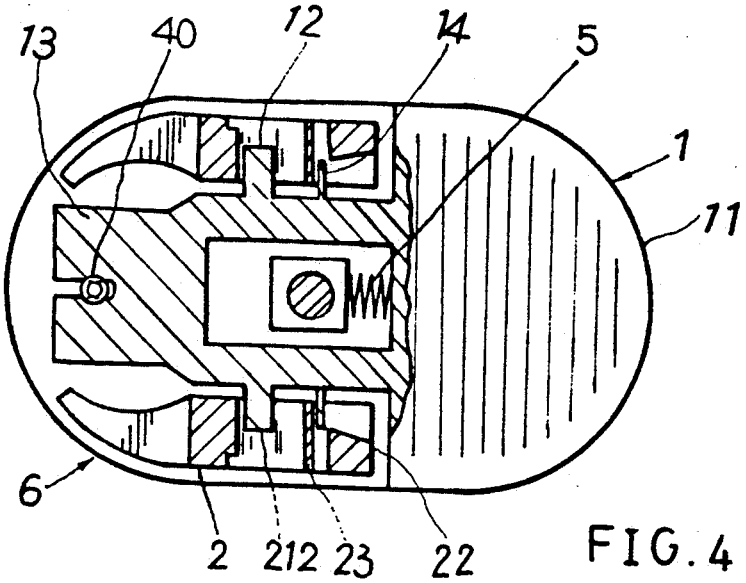
FIG. 4 is a top view illustration of the present invention as shown in FIG. 3.

For igniting the lighter as shown in FIGS. 3, 4, the lever 1 is pushed frontwardly from "P" in FIG. 1 to allow the pivot 12 to move from the first pivot hole 211 into the second pivot hole 212 in the arcuate slot 21 of the top frame 2 and the positioning pin 14 is also moved frontwardly towards the second side B of the container 6 along the guiding slot 22 until being upwardly locked into the positioning socket 23 above the guiding slot 22 as urged by the spring 5, the lever 1 is thus pushed frontwardly to also move the stem 15 frontwardly to be projectively positioned above the stem-enterable cavity 623 of the container cover 62, whereby upon a downward depression (D) of the lever 1, the stem 15 is depressed into the cavity 623 without being obstructed, allowing an upwardly raising of the nozzle 40 for opening the gas valve 4 to emit butane gas upwardly to be ignited by simultaneously depressing the lever 1 and rotating a striker wheel of the igniting means 3 rotatably mounted on the top frame 2 for sparking a flint of the igniting means 3 for igniting the lighter.

After igniting the lighter, the restoring spring 5 will restore the lever 1 rearwardly to move the stem 15 to be obstructed by the retarding platform 621 on the container cover 62 for preventing an unexpected depression of the lever, thereby preventing an unexpected ignition of the lighter. During the downward depression for igniting the lighter, the positioning pin 14 of the lever 1 has also been moved downwardly to disengage from the positioning socket 23 so that the spring 5 may retract the lever 1 rearwardly for re-setting the lever 1 to a safe state as shown in FIG. 1.

I claim:

1. A safety gas lighter comprising:

an actuating lever pivotally mounted on a top frame secured on a container cover of a gas container filled with gas therein, said lever having a locking stem protruding downwardly from said lever;

a restoring spring retained in between said actuating lever and a base portion of said top frame for normally urging said actuating lever rearwardly towards a first side of said container for limiting a downward movement of said locking stem of said lever on said container cover for preventing a downward depression of said lever and preventing an unexpected ignition of the gas lighter;

said lever operatively pushed frontwardly towards a second side of said container opposite to said first side of said container proximate to a nozzle of a gas valve provided on the container to move said locking stem to be enterable into a cavity formed in said container cover allowing a downward depression of the lever for ignition the lighter;

said actuating lever generally inclined upwardly towards the first side of the container as urged by the restoring spring and including: a depression member formed on a force end of the lever at the first side of the gas container, a lever pivot serving as a fulcrum of the lever and transversely formed on a middle portion of the lever to be pivotally mounted on the top frame, a clip portion formed on a load end of the lever for slidably holding the nozzle of the gas valve on the clip portion, at least a positioning pin protruding transversely from the lever adjacent to the depression member for operatively temporarily setting the lever at an ignition position when pushing the lever frontwardly towards the second side of the gas container having the gas valve provided in the container at the second side, the locking stem protruding downwardly from the depression member for normally locking the lever on the container cover, and a spring retainer formed on the locking stem for retaining a first spring end of the restoring spring thereon.

2. A safety lighter according to claim 1, wherein said top frame is protruded from a container cover sealably secured to an upper portion of the gas container, an arcuate slot formed in a middle portion of the frame pivotally engageable with the pivot of the lever having a first pivot hole proximate to the depression member and a second pivot hole proximate to the nozzle of the valve formed in two opposite end portions of the arcuate slot for slidably pivoting the pivot of the lever, at least a guiding slot inclinedly formed in the top frame adjacent to the arcuate slot for slidably guiding the positioning pin of he lever towards the second side of the container when pushing the lever frontwardly towards the second side for igniting the lighter, at least a positioning socket communicating with the guiding slot, at which the positioning pin of the lever is pushed extremely towards the deadpoint of the guiding slot adjacent to the first pivot hole of the arcuate slot for temporarily engaging the positioning pin with the positioning socket when raising the positioning pin as upwardly urged by the restoring spring ready for an igniting depression of the lever for igniting the lighter, and a spring holding portion formed on a base portion of the top frame for retaining a second spring end of the restoring spring opposite to the first spring end of the spring for normally urging the restoring spring upwardly towards the first side of the container.

3. A safety lighter according to claim 1, wherein said container cover includes a retarding platform formed on an upper surface of the container cover proximate to the first side of the container for stopping a downward depression of the locking stem of the lever, a limiting protrusion tapered upwardly from the retarding platform, and a stem-enterable cavity recessed downwardly in the cover adjacent to the limiting protrusion, with the limiting protrusion positioned between the retarding platform and the stem-enterable cavity to normally limit the locking stem from dropping into the cavity when locking the actuating lever and with the cavity provided for a downward depression of the locking stem when operatively depressing the lever for igniting the lighter.

* * * * *